US009487031B2

(12) United States Patent
Sasaki et al.

(10) Patent No.: US 9,487,031 B2
(45) Date of Patent: Nov. 8, 2016

(54) RECORDING DEVICE AND METHOD FOR SUPPRESSING CONTACT BETWEEN PRESSING MEMBER AND RECORDING UNIT

(71) Applicant: SEIKO EPSON CORPORATION, Tokyo (JP)

(72) Inventors: Tsuneyuki Sasaki, Matsumoto (JP); Hiroshi Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/624,359

(22) Filed: Feb. 17, 2015

(65) Prior Publication Data

US 2015/0231905 A1 Aug. 20, 2015

(30) Foreign Application Priority Data

Feb. 18, 2014 (JP) ..... 2014-028248

(51) Int. Cl.
*B41J 11/00* (2006.01)

(52) U.S. Cl.
CPC ..... *B41J 11/005* (2013.01)

(58) Field of Classification Search
CPC ..... B41J 11/005
See application file for complete search history.

(56) References Cited

U.S. PATENT DOCUMENTS

| | | | | |
|---|---|---|---|---|
| 7,810,920 | B2 | 10/2010 | Matsuhashi et al. | |
| 8,186,797 | B2 | 5/2012 | Okura et al. | |
| 8,746,871 | B2 | 6/2014 | Chiwata | |
| 2012/0162300 | A1* | 6/2012 | Hirata | B41J 2/155 347/16 |
| 2014/0210886 | A1* | 7/2014 | Driggers | B41J 11/0095 347/13 |

FOREIGN PATENT DOCUMENTS

| | | |
|---|---|---|
| JP | 2006-272731 | 10/2006 |
| JP | 2011-016268 | 1/2011 |
| JP | 2012-126057 | 7/2012 |
| WO | 2010-087181 | 8/2010 |

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A recording device includes a medium support unit for supporting a recording target medium, a recording unit capable of carrying out recording on the recording target medium, a moving unit configured to relatively reciprocate the recording target medium and the recording unit, a pressing member that is provided at a position capable of opposing the recording unit and that is capable of pressing the recording target medium supported by the medium support unit, an information acquisition unit capable of acquiring information related to the pressing member, and a controller configured to output the information acquired by the information acquisition unit.

12 Claims, 6 Drawing Sheets

RECORDING DEVICE AND METHOD FOR SUPPRESSING CONTACT BETWEEN PRESSING MEMBER AND RECORDING UNIT

BACKGROUND

1. Technical Field

The present invention relates to recording devices and methods for suppressing contact between a pressing member and a recording unit.

2. Related Art

Recording devices configured to form images by discharging ink onto recording target media have been used. Among such recording devices, a recording device that includes a pressing member configured to press a recording target medium supported by a medium support unit is disclosed in JP-A-2011-16268, for example.

However, when an existing recording device, such as the one disclosed in JP-A-2011-16268, that includes a pressing member for pressing a recording target medium supported by a medium support unit is used, there is a case in which the pressing member is raised by the recording target medium and floats because of the recording target medium being transported in an oblique manner or the like. As a result, a recording unit makes contact with the floating pressing member so as to raise a risk that at least one of the recording unit, the pressing member, and the recording target medium is damaged.

SUMMARY

An advantage of some aspects of the invention is to suppress a recording unit from making contact with at least one of a pressing member for pressing a recording target medium supported by a medium support unit and the recording target medium.

In order to solve the above-mentioned problem, a recording device according to a first aspect of the invention includes a medium support unit for supporting a recording target medium, a recording unit capable of carrying out recording on the recording target medium, a moving unit configured to relatively reciprocate e the recording target medium and the recording unit, a pressing member that is provided at a position capable of opposing the recording unit and that is capable of pressing the recording target medium supported by the medium support unit, an information acquisition unit configured to acquire information related to the pressing member, and a controller configured to output the above-mentioned information.

According to this aspect, the controller outputs information related to the pressing member. That is, with this configuration, the information can be reported by outputting the information to a reporting means such as a panel, an external monitor, or the like provided in the reporting device, for example. This makes it possible for a user to move the pressing member from a position capable of opposing the recording unit so that the pressing member and the recording unit do not make contact with each other in the case where the pressing member and the recording unit are in a state in which they are likely to make contact with each other, or the like. Accordingly, it is possible to suppress the pressing member and the recording unit from making contact with each other.

According to a second aspect of the invention, it is preferable that the recording device of the first aspect further include a reporting unit configured to report the information outputted from the controller.

According to this aspect, included is the reporting unit that is configured to input the information from the controller and report the inputted information. This makes it possible to report the information to a user without connecting an external unit as a reporting means.

According to a third aspect of the invention, it is preferable in the recording device of the first or second aspect that the information acquisition unit include a detector capable of detecting the pressing member, and the controller output information of the pressing member being present as the information when the detector detects the pressing member.

According to this aspect, the controller outputs information of the pressing member being present as the information when the detector detects the pressing member. This makes it possible for a user to move the pressing member from a position capable of opposing the recording unit so that the pressing member and the recording unit do not make contact with each other in the case where the pressing member and the recording unit are in a state in which they are likely to make contact with each other, for example.

According to a fourth aspect of the invention, it is preferable in the recording device of any one of the first through third aspects that a distance between the medium support unit and the recording unit be able to be adjusted, and the controller output information of the pressing member being unusable as the information in the case where the distance is no more than a predetermined value.

In the case where the above-mentioned distance is small, there is a risk that the pressing member and the recording unit make contact with each other even when the pressing member only floats because of the pressing member being raised by the recording target medium. According to this aspect, the controller outputs information of the pressing member being unusable as the information in the case where the distance is no more than the predetermined value. As such, in the case where the distance is no more than the predetermined value, which is a condition under which the pressing member and the recording unit are likely to make contact with each other, the controller can suppress the pressing member and the recording unit from making contact with each other by outputting and reporting the information of the pressing member being unusable as the information to the reporting means, for example.

According to a fifth aspect of the invention, it is preferable that the recording device of any one of the first through fourth aspects further include at least one of a thermometer and a hygrometer as the information acquisition unit, and the controller output information of the pressing member being unusable as the information in the case where at least one of a temperature measured by the thermometer and humidity measured by the hygrometer is at the outside of a predetermined range.

For example, under a hot and humid environment, the recording target medium is likely to cockle so that the pressing member is likely to be raised by the recording target medium. In addition, also under a low temperature environment, the recording target medium is likely to cockle in some case. According to this aspect, the controller outputs information of the pressing member being unusable as the information in the case where at least one of the temperature and the humidity is at the outside of the predetermined range. Accordingly, in the case where the conditions of a temperature and humidity are such that the pressing member and the recording unit are likely to make contact with each other, it is possible to effectively suppress the pressing member and the recording unit from making contact with each other by outputting and reporting the information of the pressing member being unusable as the information to the reporting means, for example.

According to a sixth aspect of the invention, it is preferable that the recording device of any one of the first through fifth aspects further include a heating unit for heating the recording target medium supported by the medium support unit, and the controller output information of the pressing member being unusable as the information in the case where a heating temperature of the recording target medium by the heating unit is no less than a predetermined value.

In the case where a heating temperature of the recording target medium by the heating unit is high, the recording target medium is likely to cockle so that the pressing member is likely to be raised by the recording target medium. According to this aspect, the controller outputs information of the pressing member being unusable as the information in the case where a heating temperature of the recording target medium by the heating unit is no less than the predetermined temperature. Accordingly, in the case where the heating temperature is high, which is a condition under which the pressing member and the recording unit are likely to make contact with each other, it is possible to effectively suppress the pressing member and the recording unit from making contact with each other by outputting and reporting the information of the pressing member being unusable as the information to the reporting means, for example.

According to a seventh aspect of the invention, it is preferable in the recording device of any one of the first through sixth aspects that the controller make the information acquisition unit acquire the information before printing is carried out.

According to this aspect, the controller makes the information acquisition unit acquire the information before printing is carried out. In the case where the pressing member is not present at a position capable of opposing the recording unit, it is unnecessary to move the pressing member from the position capable of opposing the recording unit and it is also unnecessary to report the information of the pressing member being unusable. As such, according to this aspect, a meaningless report to a user that the pressing member is unusable can be omitted in the case mentioned above.

According to an eighth aspect of the invention, it is preferable in the recording device of the seventh aspect that the information acquisition unit include the detector capable of detecting the pressing member, the moving unit include a carriage configured to hold the recording unit and the detector, and a distance between the medium support unit and the recording unit be larger when the pressing member is detected than the distance between the medium support unit and the recording unit when printing is carried out.

According to this aspect, a distance between the medium support unit and the recording unit is larger when the pressing member is detected than the distance between the medium support unit and the recording unit when printing is carried out. With this, it is possible for the detector to detect the pressing member before printing is carried out under conditions where the pressing member and the recording unit are unlikely to make contact with each other, and it is also possible to move the pressing member from a position capable of opposing the recording unit as needed when recording is carried out. This makes it possible to effectively suppress the pressing member and the recording unit from making contact with each other.

According to a ninth aspect of the invention, it is preferable that the recording device of any one of the first through eighth aspects be able to adjust a distance between the medium support unit and the recording unit and include the heating unit for heating the recording target medium supported by the medium support unit, and the controller control the heating unit so that a heating temperature of the recording target medium by the heating unit becomes no more than a predetermined value if the above distance is no more than a predetermined value.

In the case where the distance is small, the pressing member and the recording unit are likely to make contact with each other. Meanwhile, in the case where a heating temperature of the recording target medium by the heating unit is low, the recording target medium is unlikely to cockle so that the pressing member is unlikely to be raised by the recording target medium, whereby the pressing member and the recording unit are unlikely to make contact with each other. According to this aspect, the controller controls the heating unit so that a heating temperature of the recording target medium by the heating unit becomes no more than the predetermined value if the distance is no more than the predetermined value. Accordingly, even in the case where the distance is no more than the predetermined value, it is possible to suppress the pressing member and the recording unit from making contact with each other by making the above-mentioned heating temperature no more than the predetermined value.

According to a tenth aspect of the invention, it is preferable that the recording device of any one of the first through ninth aspects further include a transport unit for moving the recording target medium, the information acquisition unit include the detector capable of detecting the pressing member, and the detector detect the pressing member when movement of the recording target medium is stopped.

The pressing member is likely to be raised by the recording target medium when the recording target medium is moving. However, according to this aspect, the detector detects the pressing member when the movement of the recording target medium is stopped. This makes it possible to effectively suppress the pressing member and the recording unit from making contact with each other.

According to an eleventh aspect of the invention, it is preferable that the recording device of any one of the first through tenth aspects further include a pressing member moving unit configured to move the pressing member, the information acquisition unit include the detector capable of detecting the pressing member, and the pressing member moving unit retreat the pressing member from a position capable of opposing the recording unit when the detector detects the pressing member.

According to this aspect, the recording device includes the pressing member moving unit, and the pressing member moving unit retreats the pressing member from a position capable of opposing the recording unit when the detector detects the pressing member. This makes it possible to retreat the pressing member automatically, not manually by a user.

Further, according to this aspect, the controller outputs information of the pressing member being retreated from a position capable of opposing the recording unit as the information. This makes it possible for the user to recognize that the pressing member has automatically moved from a position capable of opposing the recording unit.

A method for suppressing contact between a pressing member and a recording unit according to a twelfth aspect of the invention is a method for suppressing the pressing member and the recording unit from making contact with each other in a recording device that includes a medium support unit for supporting a recording target medium, the recording unit capable of recording on the recording target medium, a moving unit configured to relatively reciprocate the recording target medium and the recording unit, the pressing member that is provided at a position capable of opposing the recording unit and that is capable of pressing the recording target medium supported by the medium support unit, and an information acquisition unit configured to acquire information related to the pressing member, and the method is characterized in that the information related to the pressing member is reported.

According to this aspect, the information related to the pressing member is reported. This makes it possible for a user to move the pressing member from a position capable of opposing the recording unit so that the pressing member and the recording unit do not make contact with each other in the case where the pressing member is present and the pressing member and the recording unit are in a state in which they are likely to make contact with each other, or the like. Accordingly, it is possible to suppress the pressing member and the recording unit from making contact with each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device according to an embodiment of the invention will be described in detail with reference to the attached drawings.

Embodiment of Recording Device (FIGS. 1 Through 5)

First, a recording device 1 of this embodiment will be generally described.

Figure 1:
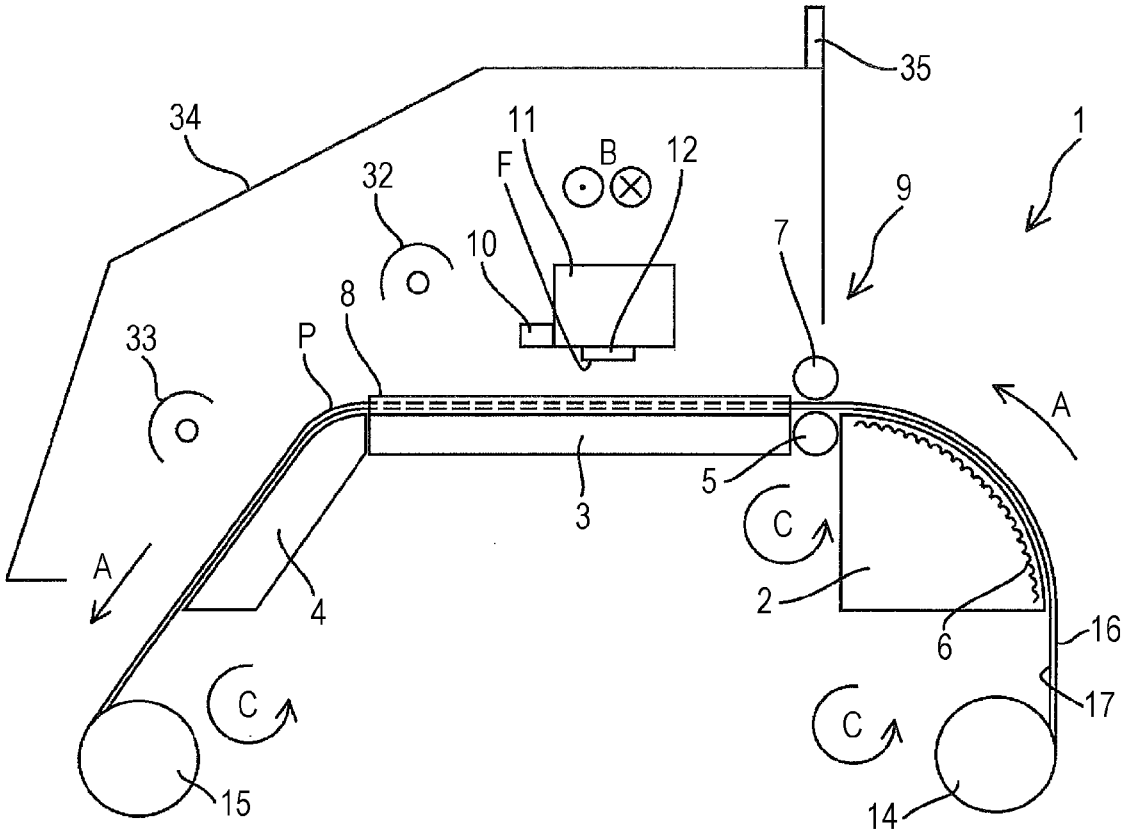
FIG. 1 is a schematic side view illustrating a recording device according to an embodiment of the invention.

FIG. 1 is a schematic side view illustrating the recording device 1 according to an embodiment of the invention.

As shown in FIG. 1, the recording device 1 of the embodiment transports a recording target medium P in a transport direction A from a setting unit 14 for setting the recording target medium P to a winding unit 15 for winding the recording target medium P via a platen 2, a platen 3, and a platen 4 which are support units for supporting the recording target medium P. In other words, a path from the setting unit 14 to the winding unit 15 is a transport path for the recording target medium P in the recording device 1, while the platens 2, 3, and 4 are the support units provided in the transport path and configured to support the recording target medium P. The setting unit 14 rotates in a rotational direction C to feed out the recording target medium P, and the winding unit 15 rotates in the rotational direction C to wind the recording target medium P.

The recording device 1 of the embodiment has a configuration capable of recording on the recording target medium P in roll form; however, the device is not intended to be limited to this configuration, and may have a configuration capable of recording on a recording target medium P in the form of cut sheets. In the case of the configuration capable of recording on the recording target medium P in the form of cut sheets, as the setting unit 14 for setting the recording target medium P, what is called a paper supply (paper feed) tray, a paper supply (paper feed) cassette, or the like may be used, for example. As a collecting unit for collecting the recording target medium P, aside from the winding unit 15, what is called a discharge receiver, a paper discharge (paper ejection) tray, a paper discharge (paper ejection) cassette, or the like may be used, for example.

In this embodiment, since the recording target medium P being wound in roll form so that the recording surface thereof faces the outer side of the roll is used, a rotational shaft of the setting unit 14 rotates in the rotational direction C when the recording target medium P is fed out from the setting unit 14. Meanwhile, in the case where the recording target medium P being wound in roll form so that the recording surface thereof faces the inner side of the roll is used, the rotational shaft of the setting unit 14 can rotate in the reverse direction with respect to the rotational direction C so as to feed out the recording target medium P.

Likewise, since the winding unit 15 of the embodiment winds the recording target medium P so that the recording surface thereof faces the outer side of the roll, a rotational shaft of the winding unit 15 rotates in the rotational direction C. Meanwhile, in the case where the medium is wound so that the recording surface thereof faces the inner side of the roll, the rotational shaft of the winding unit can rotate in the reverse direction with respect to the rotational direction C so as to wind the recording target medium P.

The platen 2 of the recording device 1 of the embodiment is provided with a heater 6. The heater 6 is provided to heat the recording target medium P (to perform what is called "preheating") before recording is carried out by a recording head 12 as a recording unit.

The recording device 1 of the embodiment is configured so that the recording target P is preheated from the side of a first surface 17 (surface on the opposite side with respect to the recording surface) using the heater 6. However, the configuration may be such that the recording target medium P is preheated from the side of a second surface 16 using a heater which is capable of heating the recording target medium P by emitting infrared light from the second surface 16 (recording surface) side of the recording target medium P, for example.

Further, the recording device 1 of the embodiment includes a driving roller 5 that is provided between the platen 2 and the platen 3 with a rotational shaft along a direction B and that applies a feeding force onto the first surface 17 of the recording target medium P, and a driven roller 7 with a rotational shaft along the direction B at a position (upper side) opposing the driving roller 5. This makes it possible to nip the recording target medium P between the driving roller 5 and the driven roller 7 serving as a pair of rollers. With this, the driving roller 5 and the driven roller 7 configure a transport unit 9. Note that the "driven roller" refers to a roller that rotates along with the transport of the recording target medium P.

When the recording target medium P is transported in the transport direction A, the driving roller 5 rotates in the rotational direction C while the driven roller 7 rotates in the reverse direction with respect to the rotational direction C.

The recording device 1 of the embodiment has a configuration in which the recording target medium P is transported relative to the recording unit in the transport direction A. However, the device may have a configuration in which only the recording unit is moved relative to the recording target medium P, a configuration in which both the recording target medium P and the recording unit are moved, or the like.

The recording device 1 of the embodiment includes the recording head 12 as a recording unit at a position opposing the platen 3. The recording device 1 forms images by discharging ink onto the recording target medium P through an ink discharge surface F of the recording unit 12 while reciprocating the recording head 12 via a carriage 11 along the direction B intersecting with the transport direction A. The carriage 11 configures a moving unit that makes the recording target medium P and the recoding head 12 relatively reciprocate.

Although details will be described later, the carriage 11 is provided with a sensor 10 that is capable of detecting a pressing member 8 configured to press the recording target medium P supported by the platen 3 as well as detecting the recording target medium P.

The recording device 1 of the embodiment is configured such that the recording target medium P is transported in the transport direction A relative to the recording head 12 and is also configured such that the recording head 12 is reciprocated along the direction B relative to the recording target medium P which is supported by the platen 3. As such, the carriage 11 that reciprocates the recording head 12 along the direction B configures, as described above, the moving unit of the recording device 1 of the embodiment.

Further, in order to dry the ink having been discharged from the recording head 12 onto the recording target medium P, there is provided, on a downstream side of the recording unit 12 in the transport direction A, a heater 32 as a heating unit capable of emitting electromagnetic waves toward a recording region of the recording head 12.

Although the heater 32 of the embodiment is an infrared heater that is provided at a position opposing the platen 3 and is capable of heating the second surface 16 of the recording target medium P to a temperature of 35° C. to 50° C., the invention is not intended to be limited to this heater. That is, a heater that is capable of heating the recording target medium P from the platen 3 side (first surface 17 side) may be used. Note that a preferable wavelength of the infrared light is 0.76 to 1,000 μm. In general, infrared light is further categorized into near-infrared, mid-infrared, and far-infrared light depending on its wavelength. Although the above categories can be defined in various ways, wavelength regions thereof are roughly 0.78 to 2.5 μm, 2.5 to 4.0 μm, and 4.0 to 1,000 μm, respectively. Among them, it is preferable to use the mid-infrared light.

In order to dry the ink having been discharged from the recording head 12 onto the recording target medium P, there is provided, on the downstream side of the heater 32 in the transport direction A of the recording target medium P, a heater 33 capable of emitting electromagnetic waves. Although the heater 33 is an infrared heater that is capable of heating the surface of the recording target medium P to a temperature of 60° C. to 120° C. so as to dry the ink used in the recording device 1 of the embodiment, the invention is not intended to be limited to such drying device. That is, as a drying device, aside from a heating device such as an infrared heater, a blower such as a fan, or the like may be used, for example.

On an exterior portion 34 of the recording device 1 of the embodiment, there is provided a touch panel 35 through which a user can input commands to the controller 18 (see FIG. 5) of the recording device 1 of the embodiment, and which is capable of reporting error information or the like of the recording device 1 outputted from the controller 18 to the user. In other words, the touch panel 35 serves as both an input unit to input commands to the controller 18 of the recording device 1 of the embodiment and a reporting unit to report various kinds of information of the recording device 1 thereof outputted from the controller 18 to the user.

In the recording device 1 of the embodiment, as shown in FIG. 1, the transport unit 9 is provided on an upstream side of the recording head 12 in the transport direction A. However, the transport units 9 may be provided on both sides sandwiching the recording head 12 in the transport direction A. In the configuration where the transport units 9 are provided on both the sides sandwiching the recording head 12, it is possible to effectively suppress transport failures such as floating of the recording target medium P, jamming caused by the floating, and so on because the recording target medium P can be nipped at both the sides sandwiching the recoding head 12.

Moreover, constituent members provided in the existing recording devices may be further included as constituent members of the recording device 1.

Next, the pressing member 8 in the recording device 1 of the embodiment will be described.

Figure 2:
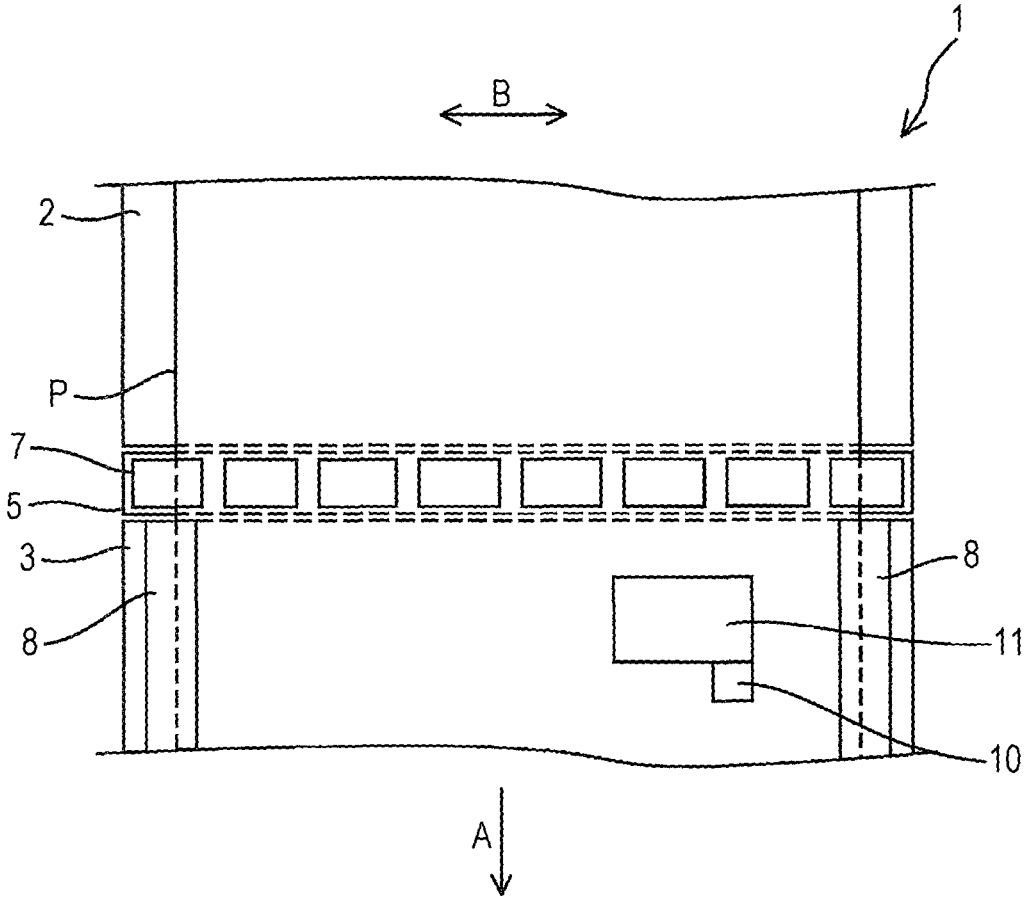
FIG. 2 is a schematic plan view illustrating a recording device according to an embodiment of the invention.
Figure 3:
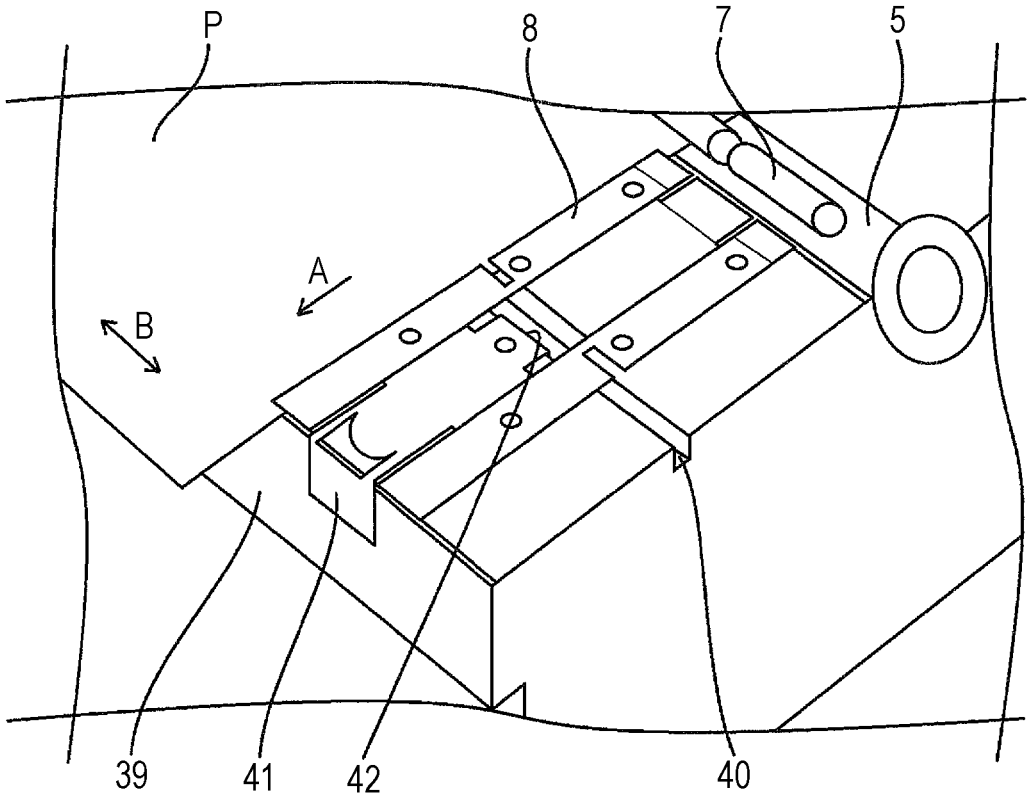
FIG. 3 is a schematic perspective view illustrating a principal portion of a recording device according to an embodiment of the invention.
Figure 4:
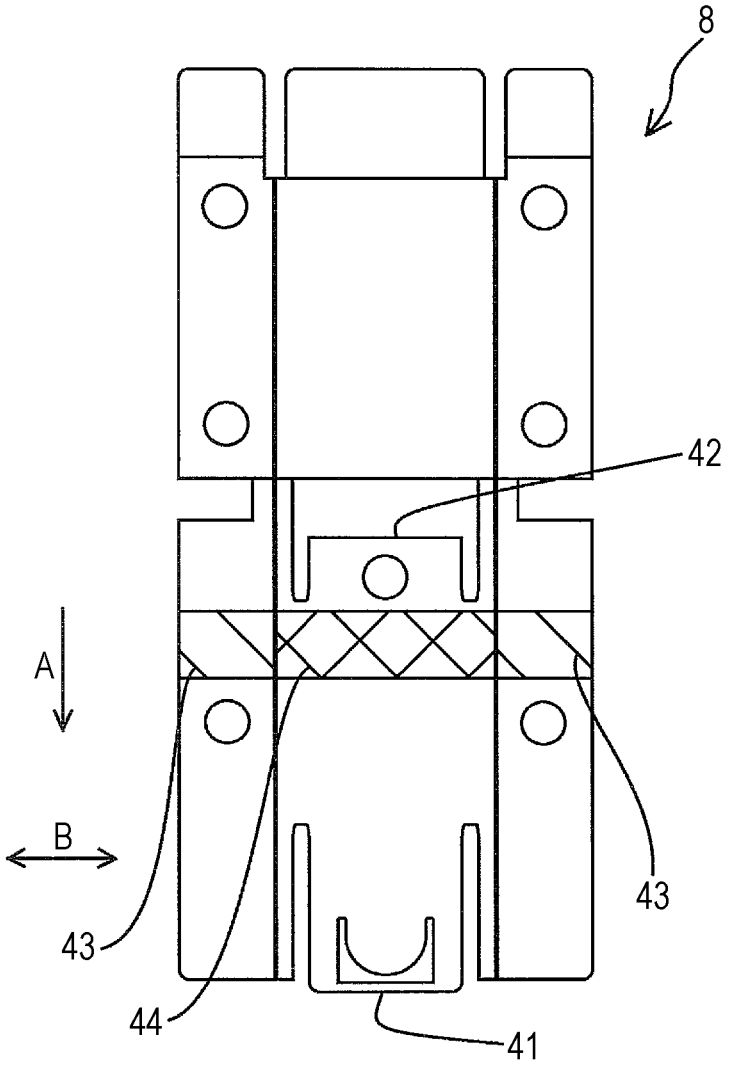
FIG. 4 is a schematic plan view illustrating a pressing member of a recording device according to an embodiment of the invention.

FIG. 2 is a schematic plan view illustrating the recording device 1 of the embodiment; FIG. 3 is a schematic perspective view illustrating a principal portion of the recording device 1 of the embodiment; and FIG. 4 is a schematic plan view illustrating the pressing member 8 of the recording device 1 of the embodiment.

As shown in FIG. 2, the pressing member 8 is provided at a position on the platen 3 capable of opposing the recording head 12 and capable of pressing the recording target medium P at both end portions thereof in the direction B. By pressing the recording target medium P at both the end portions thereof in the direction B, a risk that the recording target medium P floats, the position thereof is shifted in the direction B, or the like is reduced so that the precision of transport can be enhanced in comparison with a case in which the pressing member 8 is not used.

Since the pressing member 8 is provided at a position capable of opposing the recording head 12, it is possible to suppress the recording target medium from floating, rising, and so on in a region capable of opposing the recording head 12.

In other words, the pressing member 8 can press the recording target medium P supported by the platen 3 in a reciprocating path for the recording target medium P and the recording head 12.

The recording device 1 of the embodiment can change a platen gap (PG) which is a distance from the nozzle surface F of the recording head 12 to the platen 3 and then carry out printing. To be more specific, the device can carry out printing with the PG being set to be 1.5 mm, 2.0 mm, or 2.5 mm in accordance with types of recording target media.

The recording device 1 of the embodiment is configured such that types of recording target media can be inputted using an externally-connected PC 29 (see FIG. 5) and the touch panel 35, and the PG is automatically set based on the inputted types of recording target media.

Further, as shown in FIG. 3, a groove 40 extending in the direction B is formed in the platen 3, and restricting portions 41 and 43 are configured in the pressing member 8 of the embodiment. The pressing member 8 is placed on the platen 3 so that a downstream-side end portion 39 of the platen 3 in the transport direction A and the restricting portion 41 make contact with each other and an inner wall of the groove 40 and the restricting portion 42 make contact with each other, whereby the pressing member 8 can be set with respect to the platen 3. Being set in this manner, the pressing member 8 becomes movable in the direction B while the movement thereof in a direction along the transport direction A being restricted with respect to the platen 3.

Since the pressing member 8 of the embodiment is configured in the manner described above, it can be detached from the platen 3. However, the invention is not intended to be limited to this configuration. For example, the pressing member 8 may be so configured as to be able to be moved to a position distanced from the platen 3 even if it cannot be detached from the platen 3.

The carriage 11 can reciprocate in the direction B. As shown in FIG. 4, the pressing member 8 has an area 43 and an area 44 that are separated by predetermined different colors (identification pattern) at a position capable of opposing the sensor 10. In the embodiment, the area 43 is colored black and the area 44 is colored white.

With this configuration, by moving the carriage 11 in the direction B, the recording device 1 of the embodiment can detect presence/absence of the pressing member 8 based on whether or not the sensor 10 has detected the areas 43 and 44 (identification pattern).

Next, an electric configuration of the recording device 1 of this embodiment will be described.

Figure 5:
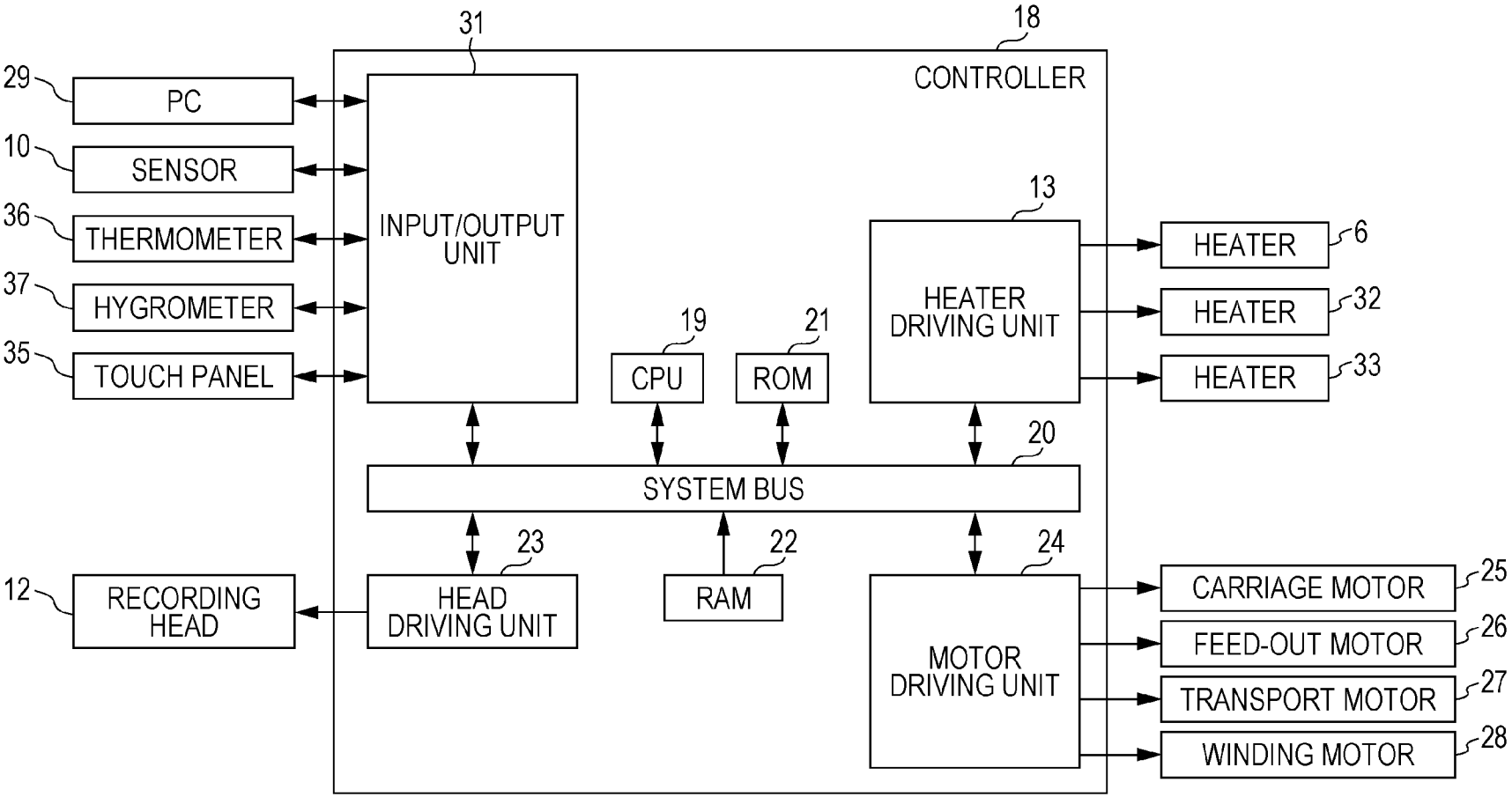
FIG. 5 is a block diagram of a recording device according to an embodiment of the invention.

FIG. 5 is a block diagram of the recording device 1 of the embodiment.

A CPU 19 configured to carry out the overall control of the recording device 1 is provided in the controller 18. The CPU 19 is connected to, via a system bus 20, a ROM 21 in which various control programs to be executed by the CPU 19, a maintenance sequence, and so on are stored and a RAM which is capable of temporarily storing data.

Further, the CPU 19 is connected to a head driving unit 23 configured to drive the recording head 12 via the system bus 20.

In addition, the CPU 19 is connected to, via the system bus 20, a motor driving unit 24 configured to drive a carriage motor 25 for moving the carriage 11, a feed-out motor 26 as a driving source of the setting unit 14, a transport motor 27 as a driving source of the driving roller 5, and a winding motor 28 as a driving source of the winding unit 15.

Furthermore, the CPU 19 is connected to, via the system bus 20, a heater driving unit 13 configured to drive the heaters 6, 32, and 33.

The recording device 1 of the embodiment includes a thermometer 36 and a hygrometer 37, and is so configured as to be able to measure an environmental temperature and environmental humidity.

The CPU 19 is connected to, via the system bus 20, an input/output unit 31 that is connected to the thermometer 36, the hygrometer 37, the sensor 10, the touch panel 35, and the PC 29 which is an external device having a monitor and so configured as to input recording data or the like to the recording device 1.

As described above, the recording device 1 of the embodiment includes the platen 3 for supporting the recording target medium P and the recording head 12 capable of carrying out recording on the recording target medium P. The device further includes the carriage 11 as a moving unit configured to relatively reciprocate the recording target medium P and the recording head 12 along the direction B. Furthermore, the device includes the pressing member 8 that is provided at a position capable of opposing the recording head 12 and that is capable of pressing the recording target medium P supported by the platen 3, and the sensor 10 as an information acquisition unit configured to acquire information related to the pressing member 8.

The controller 18 is so configured as to be able to output the information related to the pressing member to the touch panel 35 and the PC 29.

Here, the expression "information related to the pressing member" used in this specification means information of whether or not the areas 43 and 44 (identification pattern) are detected, in other words, information of presence/absence of the pressing member, that is, whether or not the pressing member 8 is present on the platen 8 as well as information of whether or not the pressing member can be used.

With the configuration described above, information related to the pressing member can be outputted and reported to the touch panel 35 and the PC 29. Accordingly, if the pressing member 8 and the recording head 12 are in a state in which they are likely to make contact with each other, a user can move (detach) the pressing member 8 from a region capable of opposing the recording head 12 so that the pressing member 8 and the recording head 12 do not make contact with each other based on the information having been outputted to the touch panel 35, the PC 29, or the like. Through this, the pressing member 8 and the recoding head 12 are suppressed from making contact with each other.

As described above, the recording device 1 of the embodiment includes the touch panel 35 for reporting information outputted from the controller 18.

This makes it possible to report the information related to the pressing member to the user without connecting an external device such as the PC 29 or the like.

The controller 18 of the embodiment can output information of the presence of the pressing member 8 as information when the sensor 10 as a detector configured to detect the pressing member 8 detects the pressing member 8.

With this, in the case where the pressing member 8 and the recording head 12 are in a state in which they are likely to make contact with each other, for example, the user can move (detach) the pressing member 8 from a region capable of opposing the recording head 12 so that the pressing member and the recording head 12 do not make contact with each other.

As described above, the recording device 1 of the embodiment can adjust the PG in three steps of 1.5 mm, 2.0 mm, and 2.5 mm.

The controller 18 is so configured as to be able to output information of the pressing member 8 being unusable as information related to the pressing member to the touch panel 35 and the PC 29 in the case where the PG is no more than a predetermined value, that is, is adjusted to be 1.5 mm.

In the case where the PG is small, there is a risk that the pressing member 8 and the recording unit 12 make contact with each other even when the pressing member 8 only floats because of being raised by the recording target medium P.

In the case where the PG is adjusted to be 1.5 mm, the controller 18 of the embodiment outputs information of the pressing member 8 being unusable as information related to the pressing member 8 to the touch panel 35 and the PC 29.

As such, in the case where the PG is adjusted to be 1.5 mm, which is a condition under which the pressing member 8 and the recording head 12 are likely to make contact with each other, the controller 18 can report the information of the pressing member 8 being unusable to the touch panel 35 and the PC 29. Accordingly, the pressing member 8 and the recording head 12 are suppressed from making contact with each other.

Although the embodiment is configured such that the PG can be adjusted in the three steps of 1.5 mm, 2.0 mm, and 2.5 mm, the PG may be adjusted in two steps or less, or four steps or more. Although the case of the PG being 1.5 mm is taken as a case of the PG being no more than a predetermined value, different values of the PG may be taken as being no more than the predetermined value.

As described above, the recording device 1 of the embodiment includes the thermometer 36 and the hygrometer 37 as the information acquisition unit.

The controller 18 is so configured as to be able to output information of the pressing member 8 being unusable as information to the touch panel 35 and the PC 29 in the case where at least one of the temperature measured by the thermometer 36 and the humidity measured by the hygrometer 37 is at the outside of the predetermined range.

For example, under a hot and humid environment, the recording target medium P is likely to cockle so that the pressing member P is likely to be raised by the recording target medium P. In addition, also under a low temperature environment, the recording target medium is likely to cockle in some case.

The controller 18 of the embodiment outputs information of the pressing member 8 being unusable as information to the touch panel 35 and the PC 29 in the case where at least one of the temperature and the humidity is at the outside of a predetermined range. As such, the controller 18 reports the information of the pressing member 8 being unusable as the information to the touch panel 35 and the PC 29 in the case where the conditions of the temperature and humidity are such that the pressing member 8 and the recording head 12 are likely to make contact with each other, whereby the pressing member 8 and the recording head 12 are effectively suppressed from making contact with each other.

Although the recording device 1 of the embodiment includes both the thermometer 36 and the hygrometer 37, the device may be so configured as to include one of them.

Further, as described above, the recording device 1 of the embodiment includes the heater 32 configured to heat the recording target medium P supported by the platen 3.

The controller 18 is so configured as to be able to output information of the pressing member 8 being unusable as information to the touch panel 35 and the PC 29 in the case where a heating temperature of the recording target medium P by the heater 32 is no less than a predetermine value.

In the case where the heating temperature of the recording target medium P by the heater 32 is high, the recording target medium P is likely to cockle so that the pressing member 8 is likely to be raised by the recording target medium P.

In the case where the heating temperature of the recording target medium P is no less than the predetermine value, the controller 18 of the embodiment outputs information of the pressing member 8 being unusable as information to the touch panel 35 and the PC 29. As such, the controller 18 reports the information of the pressing member 8 being unusable as the information to the touch panel 35 and the PC 29 in the case where the heating temperature is high, which is a condition under which the pressing member 8 and the recording head 12 are likely to make contact with each other, whereby the pressing member 8 and the recording head 12 are effectively suppressed from making contact with each other.

Moreover, the controller 18 of the embodiment is so configured as to be able to control the sensor 10 to detect the pressing member 8 before printing is carried out and output information of the pressing member 8 being unusable as information to the touch panel 35 and the PC 29 if the above sensor 10 detects presence of the pressing member 8.

In the case where the pressing member 8 is not present in a region capable of opposing the recording head, the pressing member 8 need not be moved and it is unnecessary to report information of the pressing member 8 being unusable to the user.

Accordingly, in the above case, the recording device 1 of the embodiment can omit a meaningless report to the user telling that the pressing member 8 is unusable.

As described before, the carriage 11 configuring the moving unit of the embodiment holds the recording head 12 and the sensor 10.

In the recording device 1 of the embodiment, a carriage movement mechanism (not shown) configuring the moving unit of the embodiment moves the carriage 11 so that the PG becomes larger when the sensor 10 detects the pressing member 8 than the PG when printing is carried out.

Through this, the detection of the pressing member 8 by the sensor 10 is carried out in a state in which the pressing member 8 and the recording head 12 are unlikely to make contact with each other before printing is carried out, thereby making it possible to move the pressing member 8 as needed when printing is carried out. Accordingly, the pressing member 8 and the recording head 12 are effectively suppressed from making contact with each other.

As described before, the recording device 1 of the embodiment can adjust the PG and includes the heater 32 for heating the recording target medium P supported by the platen 3.

In the case where the PG is no more than a predetermined value, for example, it is adjusted to be 2.0 mm, the controller 18 is so configured as to be able to control the heater 32 so that the heating temperature of the recording target medium P by the heater 32 becomes no more than a predetermined value.

As described above, in the case where the PG is small, the pressing member 8 and the recording head 12 are likely to make contact with each other. Meanwhile, in the case where the heating temperature of the recording target medium P by the heater 32 is low, the recording target medium P is unlikely to cockle and the pressing member 8 is unlikely to be raised by the recording target medium P, whereby the pressing member 8 and the recording head 12 become unlikely to make contact with each other.

In the case where the PG is adjusted to be 2.0 mm, the controller 18 of the embodiment controls the heater 32 so that the heating temperature of the recording target medium P by the heater 32 becomes no more than a predetermined value (for example, no more than 40° C.). As such, also in the case where the PG is adjusted to be 2.0 mm, causing the heating temperature to be no more than the predetermined value makes it possible to suppress the pressing member 8 and the recording head 12 from making contact with each other.

In the recording device 1 of the embodiment, the sensor 10 detects the pressing member 8 when the movement of the recording target medium P is stopped.

The pressing member 8 is likely to be raised by the recording target medium P during the recording target medium P being moved. However, in the recording device 1 of the embodiment, since the sensor 10 detects the pressing member 8 when the movement of the record target medium P is stopped, the pressing member 8 and the recording head 12 are effectively suppressed from making contact with each other.

The configuration of the recording device 1 of the embodiment is such that the pressing member 8 can be moved from the aforementioned reciprocating path by the user manually detaching the pressing member 8.

However, the configuration thereof may be such that a pressing member moving unit for automatically moving the pressing member 8 is included, the pressing member moving unit moves (retreats) the pressing member 8 from a region capable of opposing the recording head 12 when the sensor 10 detects the presence of the pressing member 8, and the controller 18 outputs information of the pressing member 8 having been moved as information.

Including the pressing member moving unit makes it possible to move the pressing member 8 automatically, not manually by the user.

Because the controller 18 outputs the information of the pressing member 8 having been moved as the information, the user can recognize that the pressing member 8 has been automatically moved.

Figure 6:
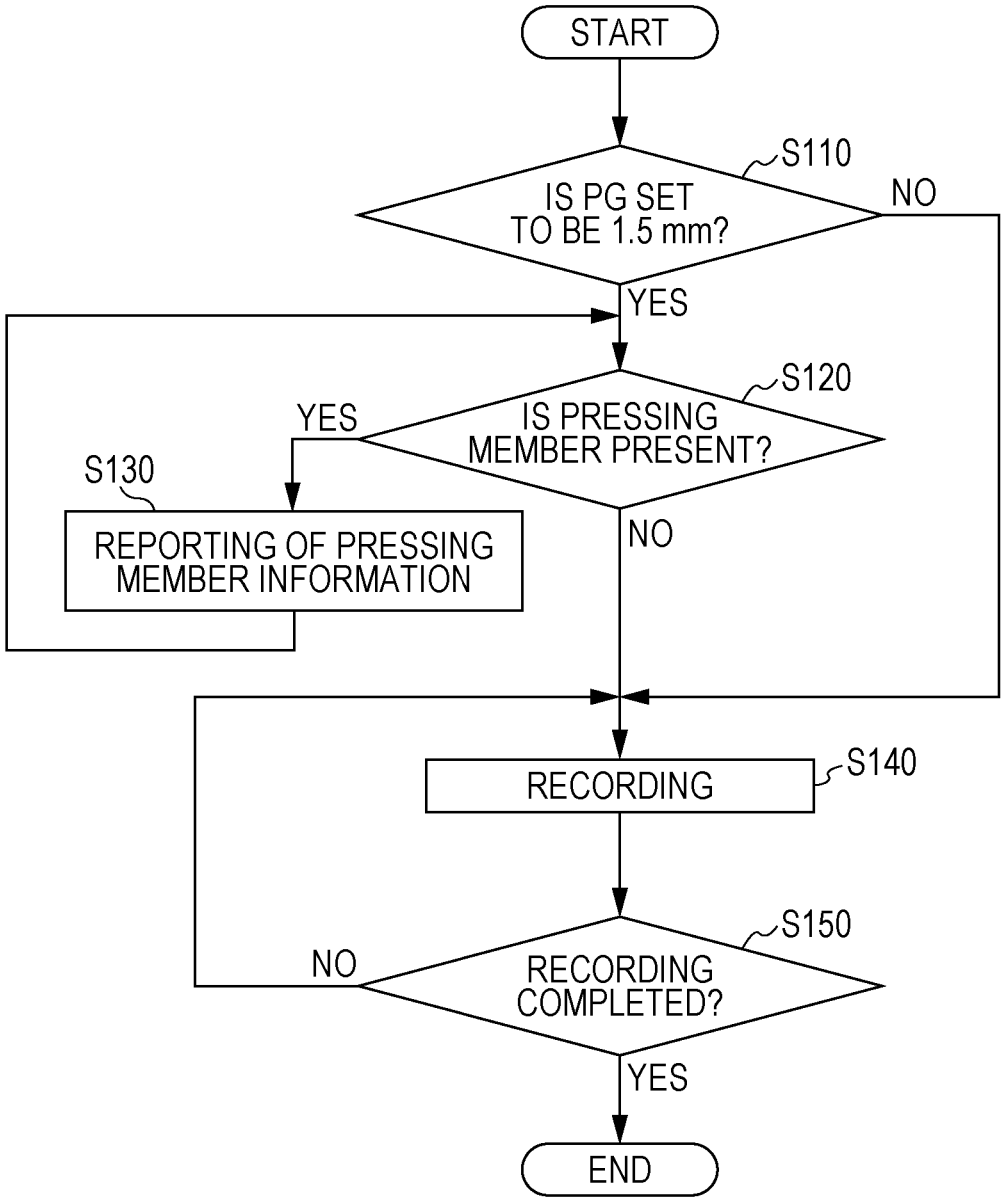
FIG. 6 is a flowchart illustrating a method for suppressing contact between a pressing member and a recording unit according to an embodiment of the invention.

Embodiment of Method for Suppressing Contact Between Pressing Member and Recording Unit (FIG. 6)

Next, an embodiment of a method for suppressing contact between a pressing member and a recording unit will be described using the recording device 1 of the aforementioned embodiment.

FIG. 6 is a flowchart illustrating a method for suppressing contact between a pressing member and a recording unit according to this embodiment.

When recording data is inputted from the PC 29 and the method for suppressing the contact between the pressing member and the recording unit of the embodiment is started, first in step S110, the controller 18 sets the PG to be one of 1.5 mm, 2.0 mm, and 2.5 mm in accordance with the type of the recording target medium P. If the PG is set to be 1.5 mm, the process goes to S120; if the PG is not set to be 1.5 mm, the process goes to step S140.

In step S120, the sensor 10 detects whether or not the pressing member 8 is present. If the controller 18 determines that the pressing member 8 is present based on the detection result by the sensor 10, the process goes to step S130; if the controller 18 determines that the pressing member 8 is absent, the process goes to step S140.

In step S130, under the control of the controller 18, information related to the pressing member 8 is reported through the panel 35 and the PC 29. More specifically, it is reported that the pressing member 8 is present in a region (reciprocating path) capable of opposing the recording head 12 and that the pressing member 8 is unusable. Thereafter, the process returns to S120 and repeats step S120 and step S130 until the pressing member 8 is moved by a user.

In step S140, recording operation is carried out based on the recording data inputted from the PC 29. Then, upon completion of the recording in step S150 based on the recording data inputted from the PC 29, the method for suppressing the contact between the pressing member and the recording unit of the embodiment is ended.

As described thus far, the method for suppressing the contact between the pressing member and the recording unit of the embodiment reports information related to the pressing member 8. This makes it possible for a user to move the pressing member 8 so that the pressing member 8 and the recording head 12 do not make contact with each other in the case where the pressing member 8 is present and if the pressing member 8 and the recording head 12 are in a state in which they are likely to make contact with each other, for example. As such, the pressing member 8 and the recording head 12 can be suppressed from making contact with each other.

In this embodiment, the pressing member 8 is detected by the sensor 10 reading the areas 43 and 44 (identification pattern) provided in the pressing member 8. However, the areas 43 and 44 (identification pattern) may be provided in the platen 3, then the pressing member 8 may be detected by a sensor finding out whether or not the pressing member 8 blocks the areas 43 and 44 (identification pattern).

The entire disclosure of Japanese Patent Application No. 2014-028248, filed Feb. 18, 2014 is expressly incorporated reference herein.

What is claimed is:

1. A recording device comprising:

a medium support unit for supporting a recording target medium;

a recording unit capable of carrying out recording on the recording target medium;

a moving unit configured to relatively reciprocate the recording target medium and the recording unit;

a pressing member that is provided at a position capable of opposing the recording unit and that is capable of pressing the recording target medium supported by the medium support unit;

an information acquisition unit capable of acquiring information related to the pressing member, wherein the information related to the pressing member comprises information that is indicative that the pressing member is likely to contact the recording unit; and a controller configured to output the information acquired by the information acquisition unit.

2. The recording device according to claim 1, further comprising:

a reporting unit configured to report the information outputted from the controller.

3. The recording device according to claim 1, wherein the information acquisition unit includes a detector capable of detecting the pressing member, and the controller outputs information of the pressing member being present as the information when the detector detects the pressing member.

4. The recording device according to claim 1, wherein a distance between the medium support unit and the recording unit can be adjusted, and the controller outputs information of the pressing member being unusable as the information in the case where the distance is no more than a predetermined value.

5. The recording device according to claim 1, further comprising:

at least one of a thermometer and a hygrometer as the information acquisition unit, wherein the controller outputs information of the pressing member being unusable as the information in the case where at least one of a temperature measured by the thermometer and humidity measured by the hygrometer is at an outside of a predetermined range.

6. The recording device according to claim 1, further comprising:

a heating unit for heating the recording target medium supported by the medium support unit, wherein the controller outputs information of the pressing member being unusable as the information in the case where a heating temperature of the recording target medium by the heating unit is no less than a predetermined value.

7. The recording device according to claim 1, wherein the controller makes the information acquisition unit acquire the information before printing is carried out.

8. The recording device according to claim 7, wherein the information acquisition unit includes the detector capable of detecting the pressing member, the moving unit includes a carriage configured to hold the recording unit and the detector, and a distance between the medium support unit and the recording unit is larger when the pressing member is detected than the distance between the medium support unit and the recording unit when printing is carried out.

9. The recording device according to claim 1, wherein the recording device can adjust a distance between the medium support unit and the recording unit, and includes the heating unit for heating the recording target medium supported by the medium support unit, and the controller controls the heating unit so that a heating temperature of the recording target medium by the heating unit becomes no more than a predetermined value if the above distance is no more than a predetermined value.

10. The recording device according to claim 1, further comprising:

a transport unit for moving the recording target medium, wherein the information acquisition unit includes the detector capable of detecting the pressing member, and the detector detects the pressing member when movement of the recording target medium is stopped.

11. The recording device according to claim 1, further comprising:

a pressing member moving unit configured to move the pressing member, wherein the information acquisition unit includes the detector capable of detecting the pressing member, and the pressing member moving unit retreats the pressing member from a position capable of opposing the recording unit when the detector detects the pressing member.

12. A method for suppressing contact between a pressing member and a recording unit in a recording device that includes a medium support unit for supporting a recording target medium, the recording unit capable of carrying out recording on the recording target medium, a moving unit configured to relatively reciprocate the recording target medium and the recording unit, the pressing member that is provided at a position capable of opposing the recording unit and that is capable of pressing the recording target medium supported by the medium support unit, and an information acquisition unit configured to acquire information related to the pressing member, wherein the information related to the pressing member is reported, wherein the information related to the pressing member comprises information that is indicative that the pressing member is likely to contact the recording unit.

* * * * *